United States Patent [19]

Poag

[11] 4,273,221

[45] Jun. 16, 1981

[54] COMBINATION VALISE AND BACKREST

[76] Inventor: Mary K. Poag, 1686 Labrador Dr., Costa Mesa, Calif. 92626

[21] Appl. No.: 864,682

[22] Filed: Dec. 27, 1977

[51] Int. Cl.[3] ..... A45F 4/00

[52] U.S. Cl. ..... 190/8; 190/1; 297/118

[58] Field of Search ..... 190/1, 2, 8; 297/118

[56] References Cited

U.S. PATENT DOCUMENTS

| | | | |
|---|---|---|---|
| 1,827,477 | 10/1931 | Kotausek | 190/42 |
| 2,047,035 | 7/1936 | Rosenberg | 190/42 |
| 4,068,786 | 1/1978 | Taniguchi | 190/2 |

FOREIGN PATENT DOCUMENTS

| | | | |
|---|---|---|---|
| 28323 | 8/1930 | Australia | 190/42 |
| 1917332 | 10/1970 | Fed. Rep. of Germany | 190/1 |
| 986147 | 3/1951 | France | 190/42 |
| 91320 | 1/1938 | Sweden | 190/8 |

*Primary Examiner*—Herbert F. Ross

*Attorney, Agent, or Firm*—George F. Bethel; Patience K. Bethel

[57] ABSTRACT

The following disclosure shows a combination valise and backrest having a compartment for carrying articles such as those articles used at the beach. The valise has two triangularly shaped end panels and a base. Overlying the edge of the end panels and affixed thereto are a pair of front and rear walls or side panels. Both of the walls or side panels are secured by means of an upper brace in the form of a rod that is supported across the upper portions of the triangular end panels which accommodate the rods in an overcenter slot configuration. The walls or side panels are comprised in part of a piece of sheet material which can be extended in connected relationship as a part thereof. The sheet of material forms a seat that can be unfolded from the side walls or panels in extended relationship for seating purposes. At the same time, the wall or side panel provides a backrest that is held in place by the weight of one sitting on the extended sheet connected to the side panel. Thus, a backrest is provided that can be later joined together and placed in the condition of a valise when it is not being used as a back support.

19 Claims, 6 Drawing Figures

COMBINATION VALISE AND BACKREST

BACKGROUND OF THE INVENTION

1. Field of the Invention

The field of this invention lies within the art of backrests and supports, as well as suitcases, carrying cases, and valises in general. More specifically, it lies within the novel area of the combination of a carrying case and a seat or support member that can be utilized and formed on an integral basis in combination with each other.

2. The Prior Art

The prior art with regard to beach bags, valises, and other carrying and tote bags has involved rigid types of bags, a canvas type of bag, and various leather cases. The bags are formed and sewn if they are tote bags or beach bags of canvas or other cloth material, so as to allow a ready access and free usage thereof, without substantial formality. After usage, the bags can then be washed and cleaned at a later point in time due to their flexible cloth nature.

This particular invention is directed toward such casual types of bags which can be taken to the beach, lake, or general recreation environments. When such a beach bag is utilized, it usually carries the contents of a beach devotee, including body lotions, suntan oil, radios, towels and other necessary items in order to enjoy the beach or casual area in which the bag is taken. Thus, it must be capable of accommodating such articles in a fairly large compartment.

It is oftentimes customary for a beach goer to carry a separate backrest or prop. Such backrests or props are normally of a style having a canvas or fabric backrest stretched across a wooden or metal frame. The backrest is then braced with a pair of angular props that are pivotally or hingedly connected to the backrest. In addition thereto, the fabric that has been stretched across the back supporting portion of the backrest has a seat or flap connected to it. In this manner, a user can place oneself on the seat or flap while at the same time leaning back against the backrest, so as to avoid contact with the underlying ground or substrata.

To utilize the foregoing valise and seats or backrests, it is difficult to carry both of them over an extended distance. To avert this, the inventor has derived a novel and new combination for carrying the bag and the backrest, as well as creating a new and utilitarian combination backrest and valise.

The combination backrest and valise of this invention incorporates a bag having end panels that come apart with sufficient space to accommodate a beach goer's gear. The end panels are of a triangular shape and terminate in a broadened base at one end and a support or catch at the other end. The two triangular side walls are spanned by a bottom or base portion.

Across the front and rear of the bag are a pair of walls or major side panels. The walls or major panels can be let down so as to allow the entire panel bag to be unfolded. The walls or side panels are affixed to the upper connection means of the triangular end panels.

One of the walls or side panels has a canvas or cloth extension sheet which folds outwardly therefrom to provide a seat for a user. In this manner, a user can lean back against the major wall or side panel connected to the seat and have a backrest provided by the truncated triangular end wall while at the same time having a seat upon which to rest.

All of the foregoing can be held together by straps, snaps, zippers, velcro attachments, or other means in order to create the combination backrest and valise of this invention.

As a consequence, this invention is to be read as a broad and novel advance over the art by providing a combination valise and beach bag.

SUMMARY OF THE INVENTION

In summation, this invention comprises a combination valise and backrest for leisure time activities.

More specifically, the invention comprises a valise having a base or bottom with two upstanding end panels. The end panels are of a truncated triangular form and are attached to a rectangular base, while at the same time providing slots or connection means at their upper ends for a pair of side panels.

A pair of rods or support members within the side panels or walls of the valise can be implaced within the slots or connection means on the upper portion of the end panels. The rods help to support the side panels and hold them to the end panels.

One of the major side panels or walls has a seat in the form of an anchoring sheet connected thereto which can be utilized for sitting on. The sheet is also in connected relationship to the base and prevents movement of the combination valise and backrest when it is being leaned against as a back support.

The entire valise and backrest are held together by means of snaps, velcro ties, or other arrangements, such as a zipper. The foregoing combination maintains the valise in its assembled form, while at the same time allowing free and easy opening with attendant utilization thereof as a seat.

It can be seen from the foregoing summary, that this invention is a substantial step over the prior art as will be defined hereinafter in the description of the preferred embodiments by providing a novel seat and bag combination.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
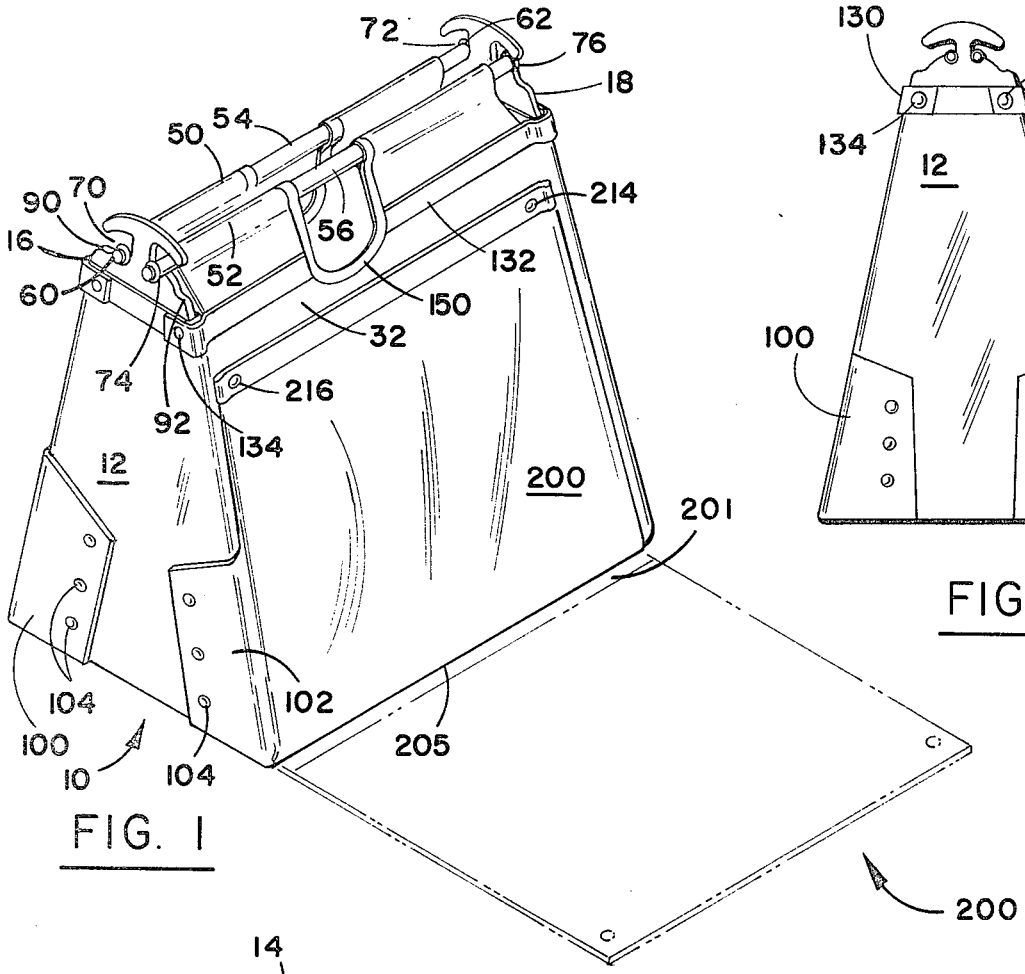
FIG. 1 shows a perspective view of the combination valise and back support that comprises this invention in its assembled and folded condition with a dotted phantom view of the seat unfolded therefrom.
Figure 2:
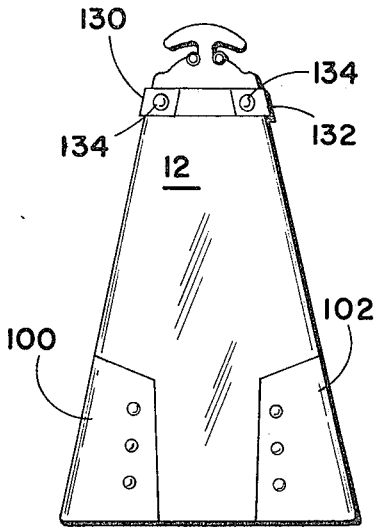
FIG. 2 shows a side elevation view of the valise looking from the left hand side of the view shown in FIG. 1.
Figure 3:
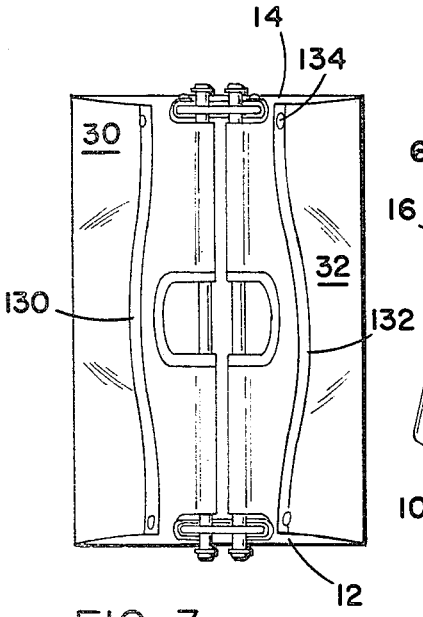
FIG. 3 shows a top plan view of the combination valise and backrest shown in FIG. 1.
Figure 4:
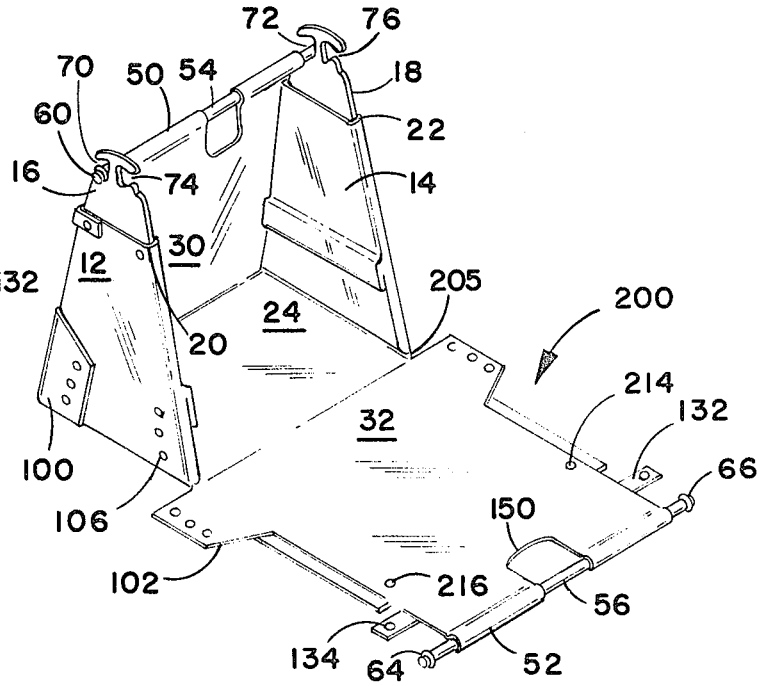
FIG. 4 shows a partially open view of the valise with one of the side panels unlatched from its support.

Looking more specifically at FIG. 1 and the other remaining figures that are ancillary thereto, it can be seen that an assembled bag 10 has been shown.

The bag 10 has end panels 12 and 14 thereof. Each end panel 12 and 14 is shown with a piece of fabric covering the end panels 12 and 14 and a rigid support member respectively 16 and 18 therein.

The rigid support members 16 and 18 are formed from a sheet such as plywood, aluminum, or other material for rigidifying the end panels 12 and 14. However, it should be understood that the end panels 12 and 14 with the rigidifying members therein can be substituted with any kind of angular brace which can conform to the periphery of the truncated triangular end panels. In other words, a formed channel can be utilized to go around the periphery and support the fabric around the end panels 12 and 14.

The fabric of the end panels 12 and 14, namely, the fabric 20 and 22, can be canvas, nylon duck, or other such materials. The fabric can be joined in its entirety to a rectangular base portion 24 which can also have a reinforcing member in the base thereof. In other words, the base member 24 can be formed from fabric with a board or stiff sheet in the base thereof such as a sheet of metal, cardboard, fiberboard, or wood.

Figure 5:
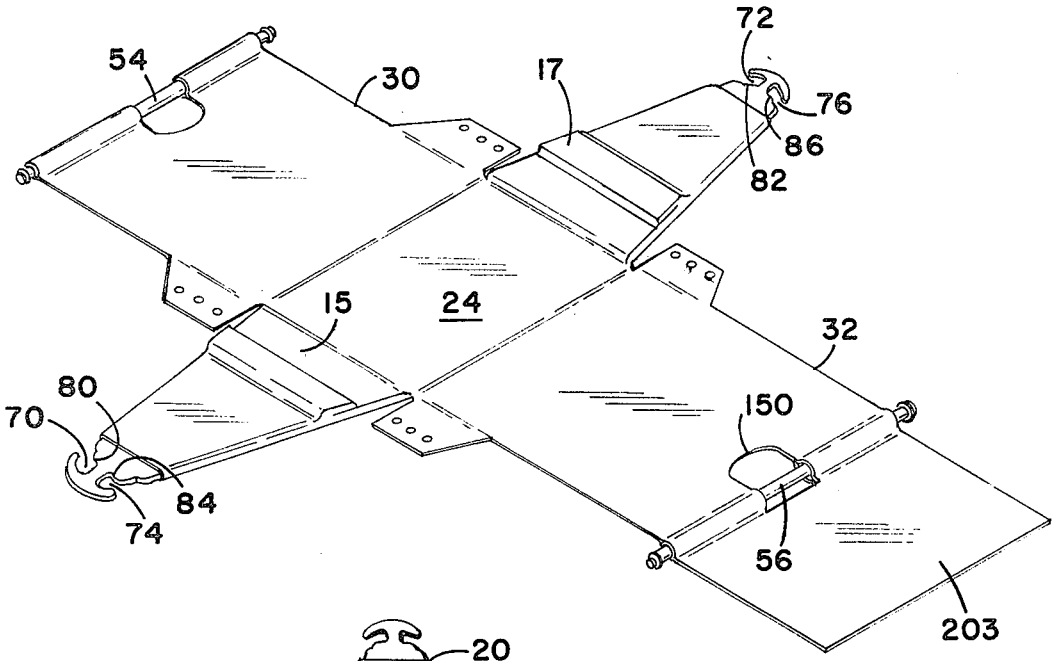
FIG. 5 shows a perspective view of the valise and back support of this invention as laid out and completely disassembled; and, FIG. 6 shows a second plan view of the laid out valise of this invention.
Figure 6:
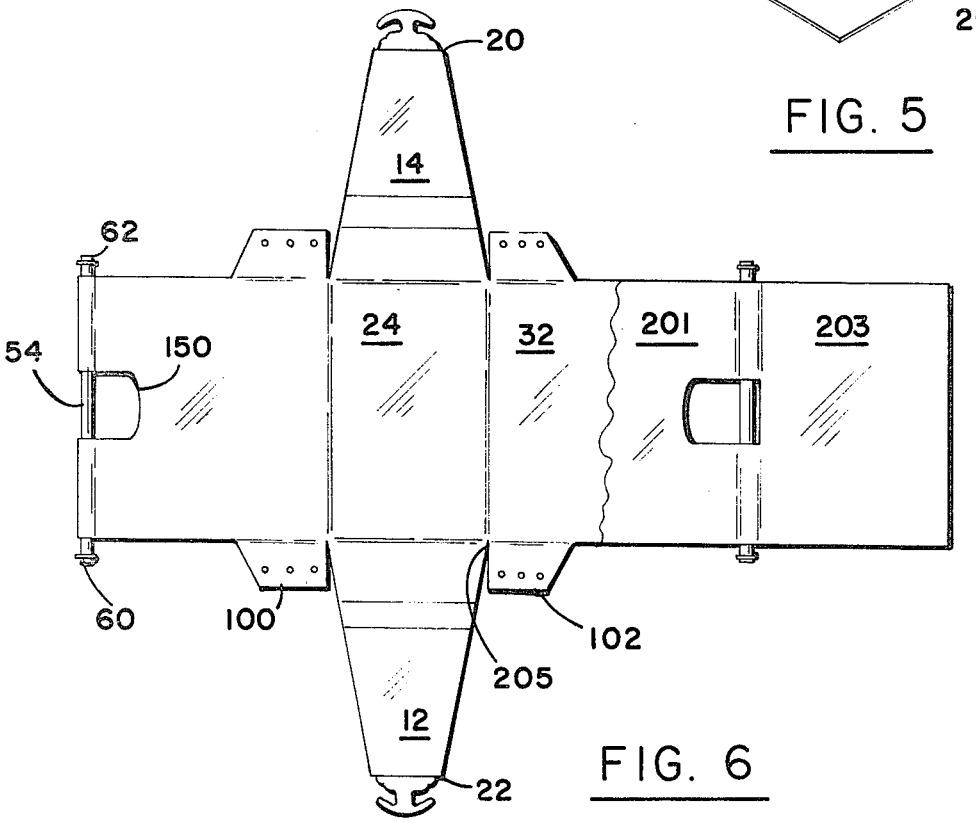

As can be seen in FIGS. 5 and 6, the entire valise and fabric sheetlike members can be laid out in their entirety.

The foregoing end panels 12 and 14 can have a pair of pockets 15 and 17 with flaps that are snap fit to the pocket to allow for placement of small objects in the valise.

The rectangular bottom 24 with the other panels can be made from one full piece of material. They can also be formed from a number of different panel sections forming the entire valise as described hereinafter.

Looking more particularly at the end panels 12 and 14, it can be seen that they meet with a pair of major walls or side panels 30 and 32. The major walls or side panels 30 and 32 are such that they provide encapsulation with the base 24 and the end panels 12 and 14 of the contents of the valise.

The valise can be folded out as shown in FIGS. 5 and 6 in its entirety, setting forth a completely laid out configuration. The folded out showing of the elements of the fabric shows one complete continuous piece of fabric. However, the invention can be formed in any suitable folded over design or stitched from components in any manner, so long as the general conformation is utilized.

The side panels 30 and 32 respectively have upper portions 50 and 52 that are looped over to receive rods, bracing members or support structures 54 and 56 passing therethrough. The rods 54 and 56 pass all the way through and serve as a rigidifying upper support. The rods 54 and 56 can be substituted by any other kind of brace or support structure. In this particular instance, they are shown as a knurled rod having end knobs 60 and 62 on rod 54 and end knobs 64 and 66 on rod 56. The end knobs 60 through 66 on the respective rods allow for the rods to be seated within notches 70, 72 and 74 and 76. The notches 70 through 76 are such that they are turned downwardly by way of a depending loop or hook configuration so that the rods 54 and 56 are received within grooves 80 and 82 as well as grooves 84 and 86 by overriding a protuberance of the slots and being placed in tightened position thereover.

In the particular design as shown, the notches 70 through 76 are implaced so as to stretch the side panels 30 and 32 into a relatively tightened position. In effect, the overcenter formation of the bulbous members, such as protuberances 90 and 92 of the respective slots 70 and 74, can create an overriding and overcenter placement of the rods. In this manner, the rods are forced over the upstanding protuberances 90 and 92 in order to effectuate a catch. Thus, the tension or the substantial tautness of the side panels 30 and 32 draws the rod ends downwardly and secures them into engaging relationship with the slots.

The side panels 30 and 32 can each be provided with flaps, such as flaps 100 and 102 on either end. The flaps 100 and 102 have buttons or snaps 104 on each end which are received on snap buttons 106 on the side of the end panels 12 and 14. Thus, the flaps 100 and 102 on either end can be formed around the ends of the end panels 12 and 14 and snapped onto the snaps or buttons 106. Any particular type of engagement means can be used to cause the flaps 100 and 102 to engage the side panels. For example, velcro attachments, snap means, zippers and other engagement means, including eyelets, can be utilized. However, in this particular embodiment, the snaps serve the purpose to provide the securement necessary for the practice of this invention.

In order to retain the upper portion of the side panels 30 and 32 in adjacent relationship to the edges of the end panels, a web, band or ribbon 130 is implaced or stitched on panel 30 and a web, band or ribbon is placed on the panel 32. These ribbons 130 have snaps 134 at their ends, which serve to engage the end panels 12 and 14 at their snap positions. The ribbons are thereby attached in a facile and easy manner to provide strength, as well as support of the upper portion of the side panels 30 and 32 at the end panels 12 and 14.

When the end panels 12 and 14 with the bottom 24 and the side panels 30 and 32 are assembled with the rod 54 and 56 implaced in the respective grooves 70 through 76, a complete valise is provided. Depressions or cutouts 150 in the panels 30 and 32 allow for a hand gripping of the portions of the exposed rod at the point where the depressions 150 are cut out from the side panels 30 and 32. The depressions 150 with rods 54 and 56 thereby create a pair of handles from the rods so that the entire valise can be picked up and transported with facility and ease.

A unique feature of this invention is that when it is upstanding in the foregoing form, it not only provides a valise, but also allows a backrest formed therefrom. The backrest is formed by virtue of a second panel sheet or flap 200 overlying the first panel 32 and is attached thereto along line 205, as well as the base 24. The panel 200 drops or folds down as can be seen in the phantom view of FIG. 1 in order to provide a seat. The panel 200 creates a situation wherein a person resting on the panel 200 can lean back against the support or side panel 32 and be braced at the back. This is due to the fact that the weight of the person on the panel 200 that is placed on the ground serves to anchor the entire valise and backrest combination so that it will not slide when a person moves back by virtue of it being secured along line 205. This is an important feature of this particular invention, because of the fact that it creates a situation wherein the entire truncated folded arrangement of the valise does not collapse or topple over when one leans against it.

A further refinement is detailed in FIGS. 5 and 6 wherein the panel 200 is shown as a folded panel forming parts or panels 201 and 203 which can be folded out to form a bigger seat or sheet 200 upon which one can sit. In particular, the panels 201 and 203 can be folded onto each other. The panel 203 is folded backwardly onto panel 201 and secured with a snap arrangement similar to the snap embodiments shown in FIGS. 1 through 4. It is secured by way of snaps 214 and 216 to the side panel 32 as shown.

In other words, the valise when it is in its assembled condition receives the base panel 200 where it is joined at seam 205 and on snaps 214 and 216. The two elements of the panel 200, namely panels 201 and 203 can be folded together and then implaced in a manner whereby panel 203 is folded onto panel 201 and the entire combination is folded against side panel 32 and held in place by snaps 214 and 216.

The panel 200 thus serves the function of anchoring the base 24 of the valise when one sits on it and leans back against panel 32.

The foregoing combination of elements allows for a novel combination valise and backrest to be provided by this invention. As a consequence, the combination and the singular elements thereof should only be read in light of the following claims as to the breadth and scope of the invention.

I claim:

1. The combination of a valise and backrest comprising:

a pair of end panels having a base portion longer than an upper portion and wherein said base portion extends beyond the upper portion to form a stabilized base for purposes of leaning thereagainst;

a bottom interconnecting said end panels;

a pair of side panels adapted for connection to said end panels so as to form a valise out of said end panels, side panels and bottom when placed in connection relationship;

a sheet in connected relationship to said bottom upon which one can sit while at the same time leaning back against a side panel adjacent thereto; and, at least one bracing member adapted for extending across the top portion of at least one of said end panels for connection to at least one of said side panels for purposes of supporting at least one of said side panels at the upper portions thereof between said end panels.

2. The combination as claimed in claim 1 further comprising:

connecting means for receiving said bracing member within said end panels.

3. The combination as claimed in claim 3 wherein:

said bracing member comprises a rod; and, said connection means comprise a slot within said end panels for receiving said rod.

4. The combination as claimed in claim 3 further comprising:

knobs at the ends of said rod for preventing it from sliding laterally within the slots of said end panels.

5. The combination as claimed in claim 3 further comprising:

a second rod within the second side panel for receipt within a notch within said other end panel.

6. The combination as claimed in claim 5 further comprising:

a cutout portion within said side panels surrounding said rod for providing a handle by said rod member that can be gripped through said cutout.

7. The combination as claimed in claim 6 further comprising:

at least one flap at either end attached to said side panels adapted for connection to said end panels in overlapping relationship thereto.

8. The combination as claimed in claim 7 wherein:

said flaps are attached by means of snaps.

9. The combination as claimed in claim 8 further comprising:

a band at the upper end of said side panels; and, means for attachment of said bands at either end to said end panels.

10. The combination as claimed in claim 9 wherein said attachment means for said bands comprise:

snaps.

11. The combination as claimed in claim 10 wherein said seating panel comprises:

at least one folding portion adapted for folding over said seating panel forming a portion thereof for receipt against said side panel.

12. A valise having a portion adapted for seating thereagainst with one's back comprising:

a pair of truncated triangular end panels;

a base member forming the bottom of said valise extending between said end panels;

a pair of side panels connected at the base member at their lower end and upper ends between said end panels;

a flap attached to one of said side panels adapted for folding out from said side panel for one to sit on while at the same time leaning back against said side panel to form a backrest;

a bracing rod connected to a portion of said side panels adapted for connection to said end panels; and, means for receiving said bracing rod on said end panels.

13. The combination as claimed in claim 12 further comprising:

a pocket on the interior side of said end panels to receive articles therein.

14. The combination as claimed in claim 12 wherein:

said means for receiving said bracing rod comprises a slot within said end panels having a lower dimension than the exterior opening portion with respect to said rod thereby forming a protuberance so that said rod can slide over said protuberance and stretch said side panel within said slot.

15. The combination as claimed in claim 14 further comprising:

means for holding said side panels against said end panels.

16. The combination as claimed in claim 15 wherein said means for holding said side panels against said end panels comprise:

at least a pair of flaps at either end of said side panels for attachment to said end panels; and, means for attaching said flaps thereto.

17. The combination as claimed in claim 16 further comprising:

means for attaching said upper portions of said side panels to said end panels.

18. The combination as claimed in claim 17 wherein both of said attachment means comprise:

velcro attachment means.

19. The combination as claimed in claim 18 wherein both of said attachment means comprise:

zipper attachment means.

* * * * *